US007672468B2

(12) United States Patent
Kaiser et al.

(10) Patent No.: US 7,672,468 B2
(45) Date of Patent: Mar. 2, 2010

(54) METHOD FOR ADJUSTING THE TRANSMISSION CHARACTERISTIC OF A HEARING AID

(75) Inventors: Eduard Kaiser, Forchheim (DE); Reinier Kortekaas, Erlangen (DE); Sören Kuhrt, Erlangen (DE); Michael Sieber, Fürth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1168 days.

(21) Appl. No.: 11/254,405

(22) Filed: Oct. 20, 2005

(65) Prior Publication Data

US 2006/0098831 A1 May 11, 2006

Related U.S. Application Data

(60) Provisional application No. 60/620,536, filed on Oct. 20, 2004.

(30) Foreign Application Priority Data

Oct. 20, 2004 (DE) ..... 10 2004 051 325

(51) Int. Cl.
*H04R 25/00* (2006.01)

(52) U.S. Cl. ..... 381/314; 381/60; 381/312; 381/321; 381/323

(58) Field of Classification Search ..... 381/60, 381/312–331; 715/763, 769, 771
See application file for complete search history.

(56) References Cited

U.S. PATENT DOCUMENTS 4,953,112 A 8/1990 Widin et al.
5,835,611 A * 11/1998 Kaiser et al. ..... 381/321
6,104,822 A * 8/2000 Melanson et al. ..... 381/320
6,115,478 A * 9/2000 Schneider ..... 381/314
6,201,875 B1 * 3/2001 Davis et al. ..... 381/314
6,449,372 B1 9/2002 Greminger
6,574,340 B1 * 6/2003 Bindner et al. ..... 381/60
6,574,342 B1 * 6/2003 Davis et al. ..... 381/314

(Continued)

FOREIGN PATENT DOCUMENTS

DE 101 52 197 A1 5/2003

OTHER PUBLICATIONS

Hyperception, "Building DSP Applications via Graphical Design," 2001.*

(Continued)

*Primary Examiner*—Curtis Kuntz
*Assistant Examiner*—Ryan C Robinson
(74) *Attorney, Agent, or Firm*—Schiff Hardin LLP

(57) ABSTRACT

In a method for adjusting the transmission characteristic of a hearing aid, the characteristic being defined by hearing aid-specific parameters, a data processing device is used that has a screen and a pointer device. On a graphics user interface of the data processing device, an object displayed in a first area of the screen is selected and copied with the pointer device and the copy is moved into the second area of the screen and stored there, with the transmission characteristic of the hearing aid being able to be changed by the stored object. Settings selected for a hearing aid or a hearing program thus can be transferred quickly and easily to a second hearing aid or a second hearing program.

18 Claims, 6 Drawing Sheets

U.S. PATENT DOCUMENTS

| | | | | |
|---|---|---|---|---|
| 6,738,964 | B1 * | 5/2004 | Zink et al. | 717/105 |
| 7,185,315 | B2 * | 2/2007 | Sharp et al. | 717/109 |
| 2004/0071304 | A1 | 4/2004 | Yanz et al. | |
| 2004/0233237 | A1 * | 11/2004 | Randow | 345/763 |
| 2005/0163328 | A1 * | 7/2005 | Colding | 381/60 |

OTHER PUBLICATIONS

Patent Abstracts of Japan Publication No. 2003142359 A, for Japanese Application 2001335144.

* cited by examiner

METHOD FOR ADJUSTING THE TRANSMISSION CHARACTERISTIC OF A HEARING AID

RELATED PROVISIONAL APPLICATION

This application claims the benefit of the filing date of provisional application Ser. No. 60/620,536, filed Oct. 20, 2004.

BACKGROUND OF THE INVENTION

1. Field of the Invention

The present invention concerns a method for using a data processing device that includes a screen and a pointer device to adjust a hearing aid transmission characteristic defined by parameters specific to the hearing aid concerned.

2. Description of the Prior Art

Because of different manufacturers, the diversity of hearing aid types available, and the multiplicity of hearing aid parameters that can be changed by adjusting controls or by programming, such as frequency response (e.g. signal edge displacement, rise time in the low and high tone range), gain, starting point of AGC, peak clipping, etc. hearing aid acousticians are confronted with such a large number of different programming options that, solely from the point of view of the time involved, it is no longer worthwhile to go through all these options to arrive at an optimum adjustment. Moreover, a tedious adjustment process of this type would not be acceptable to users.

Automated adjustment methods thus have been proposed (e.g. U.S. Pat. No. 4,953,112). Even in such cases, however, the hearing aid acoustic engineer is still confronted by a number of different setting options that have an effect on the acoustic behavior of the hearing aid.

From DE 44 18 203 C2 a method of using a personal computer to adjust the transmission characteristic of a hearing aid defined by device-specific parameters is known, in which a memory for basic values of a hearing aid setting, in conjunction with an algorithm and a data memory, supplies transmission characteristic of the hearing aid and displays this information as a graphics curve on the screen of a personal computer. A computer mouse with a pointer that can be positioned on the display is used as a pointer device for the adjustment process, so that points or sections of a graphics curve to be changed can be clicked on and moved, thereby changing the shape of the transmission curve. This process is repeated until, once the desired curve has been obtained, the parameters for the desired curved are transmitted by wire or by the remote control to the hearing aid.

Graphics user interfaces of known computer applications frequently provide a functionality referred to as "drag-and-drop". In such cases an object in the graphics user interface is clicked on with the left button of a computer mouse, the button is then held down while the computer mouse drags this object to another location in the graphics user interface and the left mouse button is released again to drop the object, in which case the object is stored at this other location of the user interface and overwrites the original content of the user interface at this location. This allows complex data to be manipulated relatively quickly and easily.

The use of a clipboard for copying individual characters or character strings is known from the Microsoft Windows® operating system for personal computers. In such cases the characters to be copied are marked and stored in the clipboard by pressing keys on the computer keyboard or by using a computer mouse. The content of this clipboard can then be inserted later at selected locations of a graphics user interface.

A method for operation of a programming device for a hearing aid is known from DE 101 52 197 A1, in which parameters to control the signal processing in the hearing aid as well as characteristic and functions of the hearing aid are set using the programming device. This known method includes the following steps:

a) Activating recording means, b) Executing an operating step at the programming device c) Using the recording means to record the operating step and/or at least one absolute or relative parameter change brought about by the operating step, d) Repeating steps b) and c) until an operating sequence is complete, e) Deactivating the recording means, f) Executing the operating steps recorded in steps in steps a) to e) and/or relative or absolute parameter changes brought about by the operating steps EP 1 142 451 B1 discloses a method for binaural adjustment of transmission characteristics for a hearing aid composed of one part for the left ear and one part for the right ear, with the aid of a data processing system to which a pointer device and a display unit can be connected, with the pointer device being used to change parameters of the transmission characteristics and with the parameters of the one hearing aid part being able to be adjusted both independently of the parameters of the other hearing aid part and also simultaneously with the parameters of the other hearing aid part.

SUMMARY OF THE INVENTION

An object of the present invention is to further simplify the adjustment of a hearing aid by means of a data processing system with a graphics user interface.

This object is achieved in accordance with the invention by a method for adjusting a transmission characteristic of a hearing aid defined by hearing aid specific parameters using a data processing device having a screen and a pointer device, by selecting an object displayed in a first screen area in a graphics user interface with the pointer device, copying it and then moving the copy using the pointer device into a second area of the screen and storing it there, with the transmission characteristic of the hearing aid being able to be changed by the stored object.

The above object is further achieved by first selecting with the pointer a graphics object displayed in an area of the screen in the graphics user interface and copying it onto a clipboard and subsequently inserting the copy using a pointer device into a destination area, with the transmission characteristic of the hearing aid being able to be changed by the inserted graphics object.

The basis of the invention is to use drag-and-drop functionality or a clipboard when making adjustments to hearing aids. The electronic data processing device used for the adjustment can be a conventional personal computer (PC) that includes a screen and a pointer device (e.g. computer mouse ) and in which special software in accordance with the invention is installed.

In principle hearing aid adjustments involve a number of different objects that can be copied using "drag-and-drop". An object in the sense of the invention means in very general terms, a specific first area of the screen that is copied into a second area of the screen and thereby overwrites the original content of this second area of the screen, which enables settings or parameters of a hearing aid to be changed. The scope of these screen sections is to be seen as very wideranging in this case. Examples are as follows: a counter value, a specific characteristic transmission curve, a diagram comprising one or more characteristic transmission curves, a bar chart, settings for graphics controls (push buttons, setting buttons, controls etc..), selection elements (on-off markings), specific character strings (file names) etc. An object in the sense of the invention in this case can include any combination of these types of individual elements. Furthermore graphics objects are also relevant in conjunction with the invention, these differing from the above-mentioned objects in that a graphics object means not simply a character that can. be entered via a computer keyboard or a sequence of such characters.

A screen object in accordance with the invention is preferably an individual parameter or groups of parameters that are to be copied. In this case the parameters can be represented by a numerical value or also by a specific graphics symbol. The symbol illustrates, for example, whether a specific function (e.g. filter, output limiter) is switched on or switched off. For a larger range of parameter values the graphics symbols can also provide a rough illustration of the value set, e.g. the volume setting or the gain in the form of a bar display. In accordance with the invention the numerical value or the graphics symbol which represents the concrete setting is then copied into another area of the graphics user interface. In addition the object involved can also be at least one transmission curve or at least one section of the transmission curve. Transmission curves are frequently selected means for adjusting hearing aids for graphics illustration of the transmission behavior of the hearing aid concerned. This transmission behavior is generally strongly frequency-dependent. The appropriate transmission curves can be quickly and easily copied using the invention. In addition a specific control element can also be copied as such into the user interface within the context of the invention. An example of this is a graphics symbol for a control element for setting up the overall gain of a hearing aid system for binaural supply, in which case copying of the overall gain of the binaural hearing aid system can then be used to adjust the two hearing aids.

To enable repeated access to a hearing aid adjustment once it has been made the settings and parameter values produced during the adjustment session are stored. Usually the stored data is given a file name so that it can be easily found again. The invention also includes the copying of specific memory content and especially the copying of file names using the graphics user interface.

In an adjustment method in accordance with the invention the graphics user interface is divided into at least two areas, with a setting made the first area being copied into the second area. The two areas allow a distinction to be made between the adjustment of different hearing programs of one and the same hearing aid for example. Hearing programs are used generally for adjusting the signal processing of a hearing aid to specific hearing situations such as for example "speech in a quiet environment", "speech in a noisy environment", "driving in a car", "telephone", etc. With many of these different hearing programs the totality of the adjustment parameters is very similar. The invention offers the advantage that the settings and parameters selected in conjunction with a specific hearing program are able to be transmitted quickly and easily to a second hearing program. It is only then necessary to make the changes in this second program in relation to the first program.

Naturally the sequence of the individual hearing programs can be changed quickly and easily by means of the invention by way of the graphics user interface. This is especially important since hearing aids frequently feature only one button as a control for switching over the programs, which only increments the program number by one each time it is pressed or goes from the. highest program number back to hearing program 1. Thus for example the invention typically allows the parameters and settings of a specific hearing program to be transferred easily to the hearing program with the program number 1.

The invention offers not only advantages for setting an individual hearing aid but also in those situations where a number of hearing aids, for example for binaural supply to a user, are to be adjusted. Thus the first area of the graphics user interface can advantageously be provided for adjusting a first, e.g. the left-side hearing aid and the second area of the graphics user interface for adjusting the right-side hearing aid. Since both ears of a user frequently have the same hearing loss it makes sense to initially transfer the settings selected for supply to one ear at a hearing aid to the second hearing aid and then to merely make a fine adjustment at the hearing aid for supplying the second ear. In addition the parameters and settings copied in accordance with the invention can originate from an object library, which especially contains standard settings for frequently occurring hearing losses. In particular for the selection of these types of standard settings which can serve as a starting point for an individual adjustment, the presetting by means of the invention can use a high level of abstraction as its starting point. Advantageously in this case a plurality of individual settings and parameter values do not have to be copied but merely a specific memory area within the data processing device, an operation which can be executed merely by copying a specific file and storing this file in an area of the graphics user interface provided for adjusting the hearing aid.

The practical implementation of the drag-and-a drop functionality preferably is undertaken in conformity with the method known from Microsoft Windows®. In this system an object to be copied is selected by positioning the mouse pointer on the object and clicking on the left mouse button. In this case an object to be copied can consist of a number of graphics elements, e.g. a number of characteristic transmission curves which can be jointly selected in the way described. In addition the computer mouse can also be used to define a window on the graphics user interface so that the object to be copied contains a number of graphics elements which all lie within the defined window. Especially for the simultaneous selection of a number of graphics elements it can be worthwhile, in addition to clicking on the left mouse button, to also have to press specific keys on a keyboard of the data processing device.

A selected object is advantageously clearly distinguished from a non-elected object, e.g. by a particular coloring, the choice of specific types of line, flashing, etc In addition the user can also recognize with a preferred embodiment of the invention when a copied object is precisely above the target area of the copied object on which it can basically be stored. For example it is not sensible to store numerical values of a specific parameter in a diagram of a transmission function. The adjustment software should thus be embodied so that this is not possible. Conversely the user should however recognize when the copied object, e.g. a characteristic transmission curve, is now over an area, e.g. a diagram, in which it can sensibly be stored. To illustrate this process graphically either the copied object or the target area can then change in such a way that it is signaled to the user that he can now release the left mouse button and thereby can sensibly store the object

DESCRIPTION OF THE PREFERRED EMBODIMENTS

Figure 1:
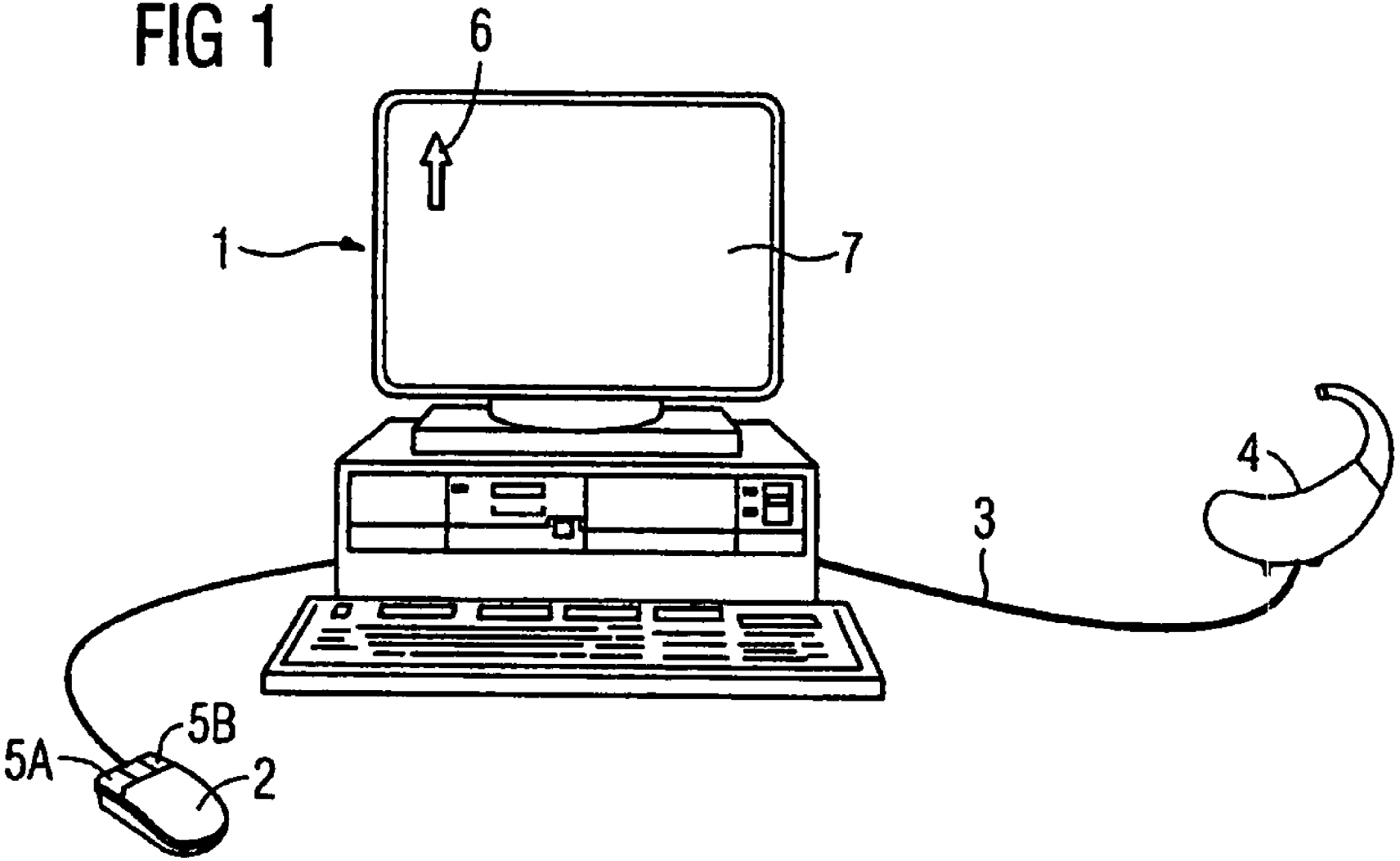
FIG. 1 shows a data processing device suitable for adjusting a hearing aid in accordance with the invention.

FIG. 1 shows in a schematic diagram and with different scales, a data processing device in the form of a personal computer 1 with a pointer device in the form of a computer mouse 2 and a programmable hearing aid 4 which can be connected via an interface not shown in the drawing and a cable 3. A pointer 6 which can be operated using switches in the form of mouse buttons 5A and 5B is shown on a screen 7 of the data processing device. The data processing device includes in a known way data memory and computation devices which are also not shown in the drawing. Software specifically adapted for adjusting hearing aids is installed on the data processing device.

Figure 2:
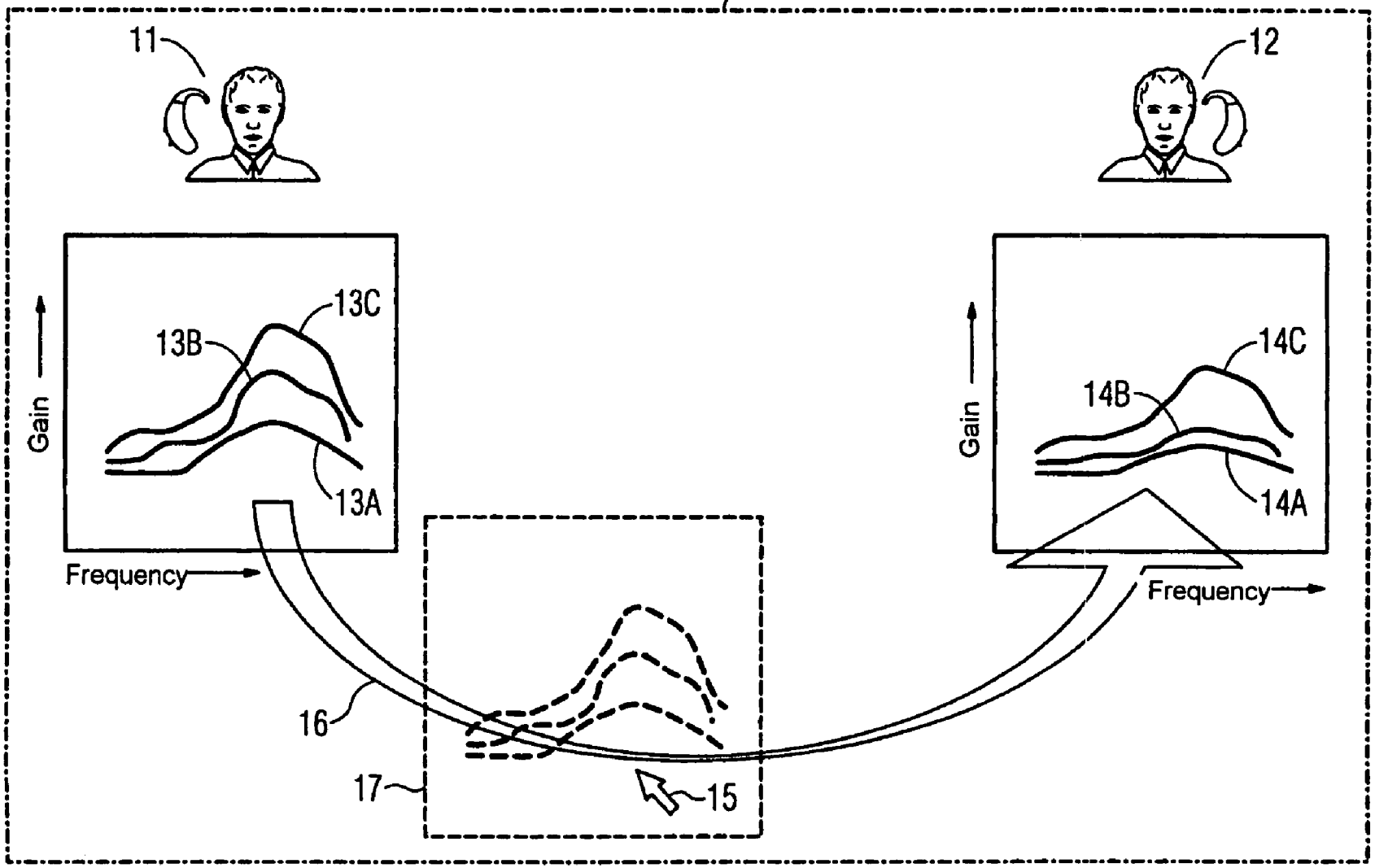
FIG. 2 shows the transmission of characteristic transmission curves set for a right-side hearing aid to a left-side hearing aid.

FIG. 2 shows a graphics user interface for individually adjusting a left-side and a right-side hearing aid to the hearing loss of a user. The screen content 10 is in this case divided into a left-side screen area and a right-side screen area, with settings for the right-side hearing aid being able to be made in the left-side screen area and settings for the left-side hearing aid of the user in the right-side screen area. This is indicated by the two graphics symbols 11 and 12. Characteristic transmission curves 13A, 13B, 13C or 14A, 14B, 14C can be seen for both the right-side hearing aid and also for the left-side hearing aid. These illustrate the gain over the frequency for input signals with a low, medium and high signal level. It can also be seen that the transmission functions are different for the right-side and the left-side hearing aid. If the same functions are now to be set for the left-side hearing aid as for the right side hearing aid this setting can be made easily and quickly in accordance with the invention by using the graphics user interface in conjunction with the computer mouse. To this end of the settings of the right-side hearing aid that are to be copied are first to be selected. The selection can be made for example by drawing a box with the computer mouse which in the exemplary embodiment encloses all three characteristic transmission curves 13A, 13B, 13C of the right-side hearing aid. This is possible for example by positioning a mouse pointer 15 initially above the transmission curves 13A, 13B and 13C and subsequently, while. holding down the left mouse button, dragging it to a position to the right below the characteristic transmission curves,. with the marked area being indicated by a rectangle on the screen. It should be noted that this type of marking represents one of a number of options so that the invention is not restricted to this type specifically described for the exemplary embodiment. For example the three characteristic transmission curves 13A, 13B and 13C can also be clicked on one after the other in order to mark them jointly. The marked area is then copied into the right-side screen contents by positioning the mouse pointer for example in the marked area and subsequently, while holding down the left mouse button, dragging it over the diagram shown in the right-side screen area. This process is indicated in FIG. 2 by the arrow 16 which is merely intended to illustrate the copying process and is not part of the screen contents. While the object is being dragged a copy 17 of the marked area remains visible so that the user can follow the current position of the copied area exactly. Furthermore it can be seen from the copy 17 when it is over an area into which it can sensibly be stored, e.g. over the diagram shown in the right-side screen half, so that the characteristic curves shown there 14A, 14B and 14C can be over-written by the characteristic curves 13A, 13B and 13C when the mouse button is released. For example of the copy 17 of the marked area can change its line color or line type or can flash to indicate to the user that settings will be overwritten when the mouse button is released.

Figure 3:
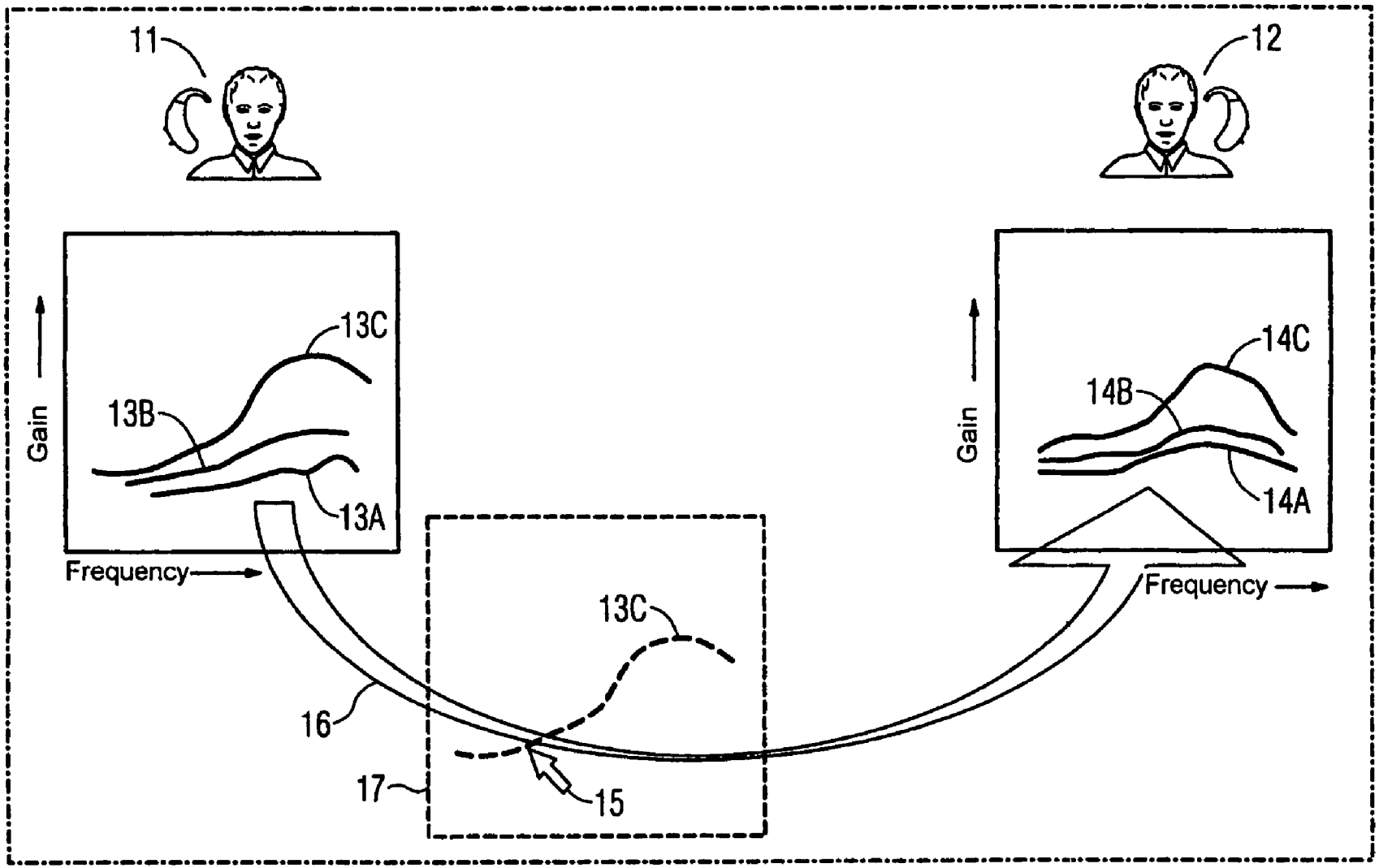
FIG. 3 shows the transmission of an individual transmission curve set for a right-side hearing aid to a left-side hearing aid.

FIG. 3 shows a further exemplary embodiment of the invention. In contrast to the exemplary embodiment shown in FIG. 2, in this exemplary embodiment only one of the three characteristic curves 13A, 13B, 13C is marked so that in the exemplary embodiment only the characteristic curve 13C of the gain over frequency for a low signal level of the input signal is copied and is transferred for the left-side hearing aid. It should be pointed out that this characteristic curve 13C does not necessarily have to replace the characteristic curve 14C of the left-side hearing aid but can also replace the curve 14A or 14B depending on which of the three characteristic curves 14A to 14C the characteristic curve 13C is dragged over. Thus for example the characteristic curve 14B can be replaced by a characteristic curve with the basic curve shape of the curve 13C, with the absolute values of the gain being able to be adjusted graphically by parallel movement of this curve.

Figure 4:
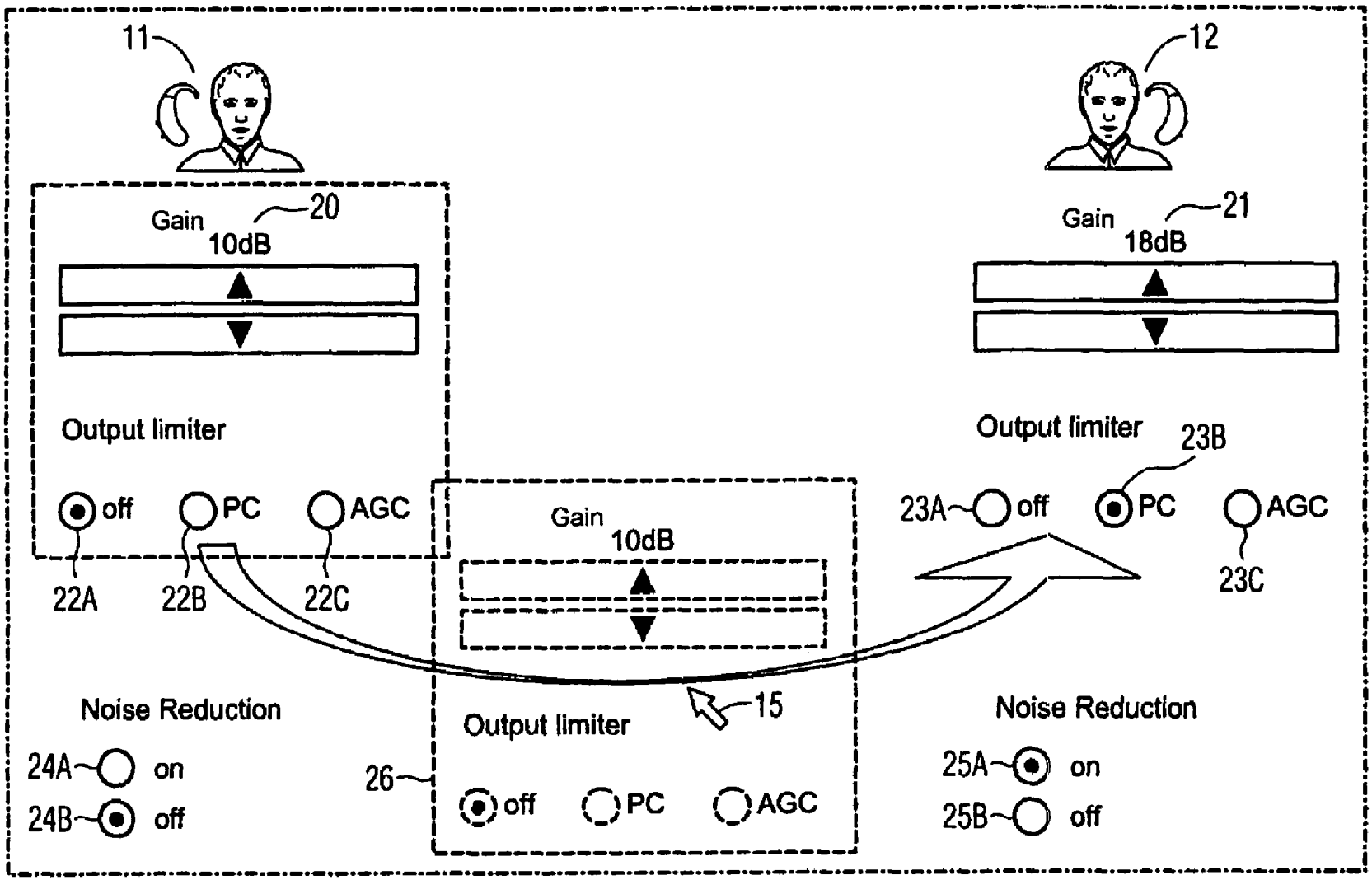
FIG. 4 shows the transmission of settings and parameter values from a right-side hearing aid to a left-side hearing aid.

FIG. 4 illustrates an exemplary embodiment in which other hearing aid settings rather than characteristic curves, for example the numerical values 20, 21 which determine the gain, or settings made by means of graphics selection elements 22A, 22B, 22C or 23A, 23B, 23C are transferred for the left-side hearing aid. The method of operation here is principally the same as that described in connection with FIGS. 2 and 3. The only particular feature to be noted is that here, as also already described in connection with FIG. 3, only a part of the settings selected in the current screen of the graphics user interface for the right-side hearing aid are selected and copied. With the copying process in the exemplary embodiment in particular the settings regarding noise reduction which are defined for the right-side hearing aid by the selection elements 24A and 24B and for the left-side hearing aid by the selection elements 25A and 25B are not transmitted to the left-side hearing aid. After the copying process the numerical value 21 (18 dB) is overwritten by the numerical value 20 (10 dB) of the right-side hearing aid. The same applies for the selection elements 23A to 23C of the left-side hearing aid which are overwritten by the corresponding settings of the right-side hearing aid. The settings 25A and 25B with regard to the noise reduction of the left-side hearing aid remain unaffected by the copying process since these were not selected for the copying process. The copied area is displayed to the user when it is dragged through the copied screen section 26 which, by contrast with the original section however is only shown as a dashed outline.

Figure 5:
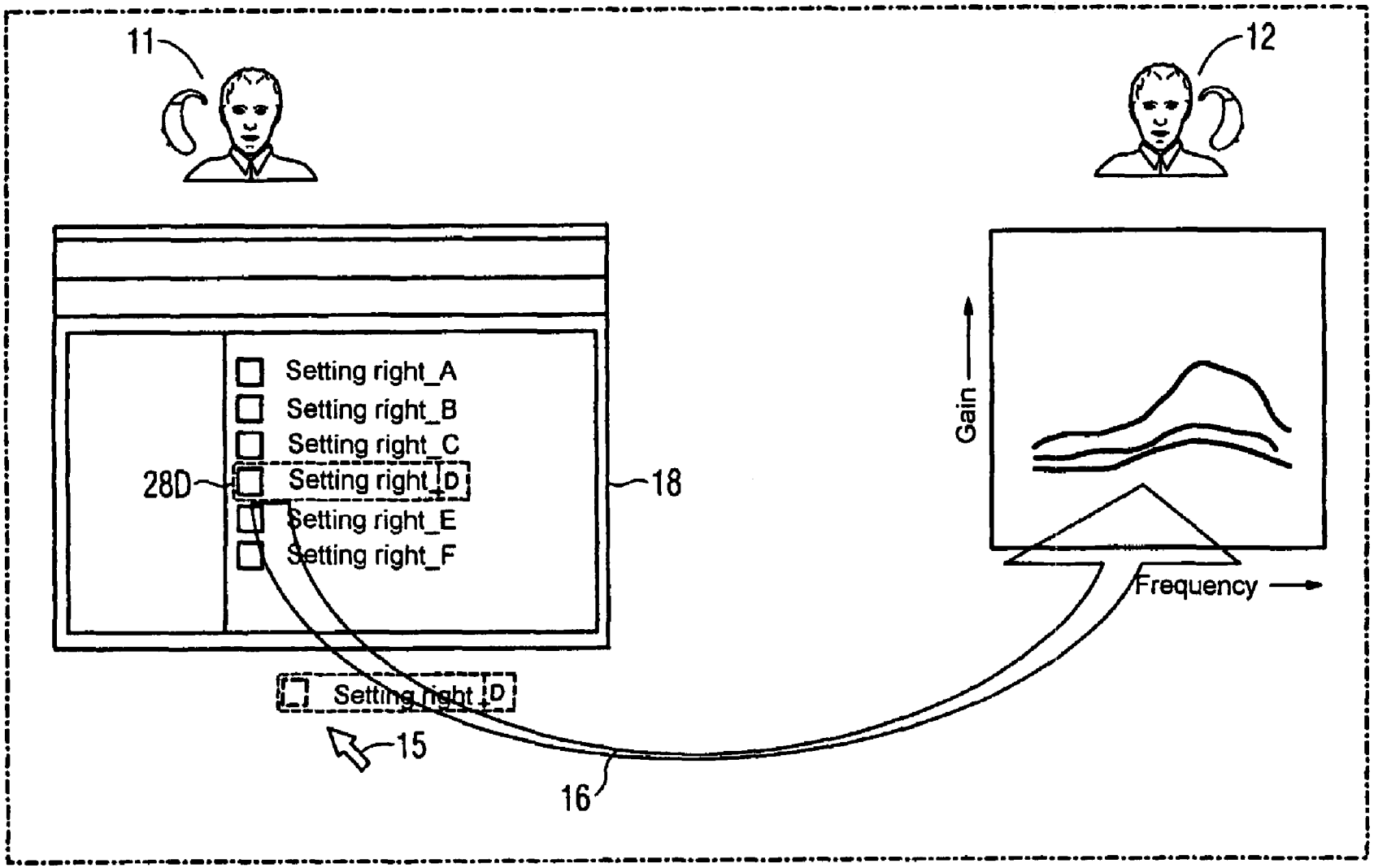
FIG. 5 shows the transmission of settings stored in an object library on a left-side hearing aid.

In the exemplary embodiment in accordance with FIG. 5 the graphics presentation of the settings which are to be transferred from one hearing aid to another is undertaken partly at a higher level of abstraction. Thus the settings pertaining to the right-side hearing aid are merely symbolized by a file name 28D, with a file being able to be selected from a number of files of a folder 28 directly and dragged over a diagram for the left-side hearing aid so that by the associated copying process the settings stored in file 28D are transferred into the diagram displayed for the left-side hearing aid and are also presented graphically there after the copying process. Naturally in this case the same level of abstraction can be selected for the left-side hearing aid as has been selected for the right-side hearing aid.

Figure 6:
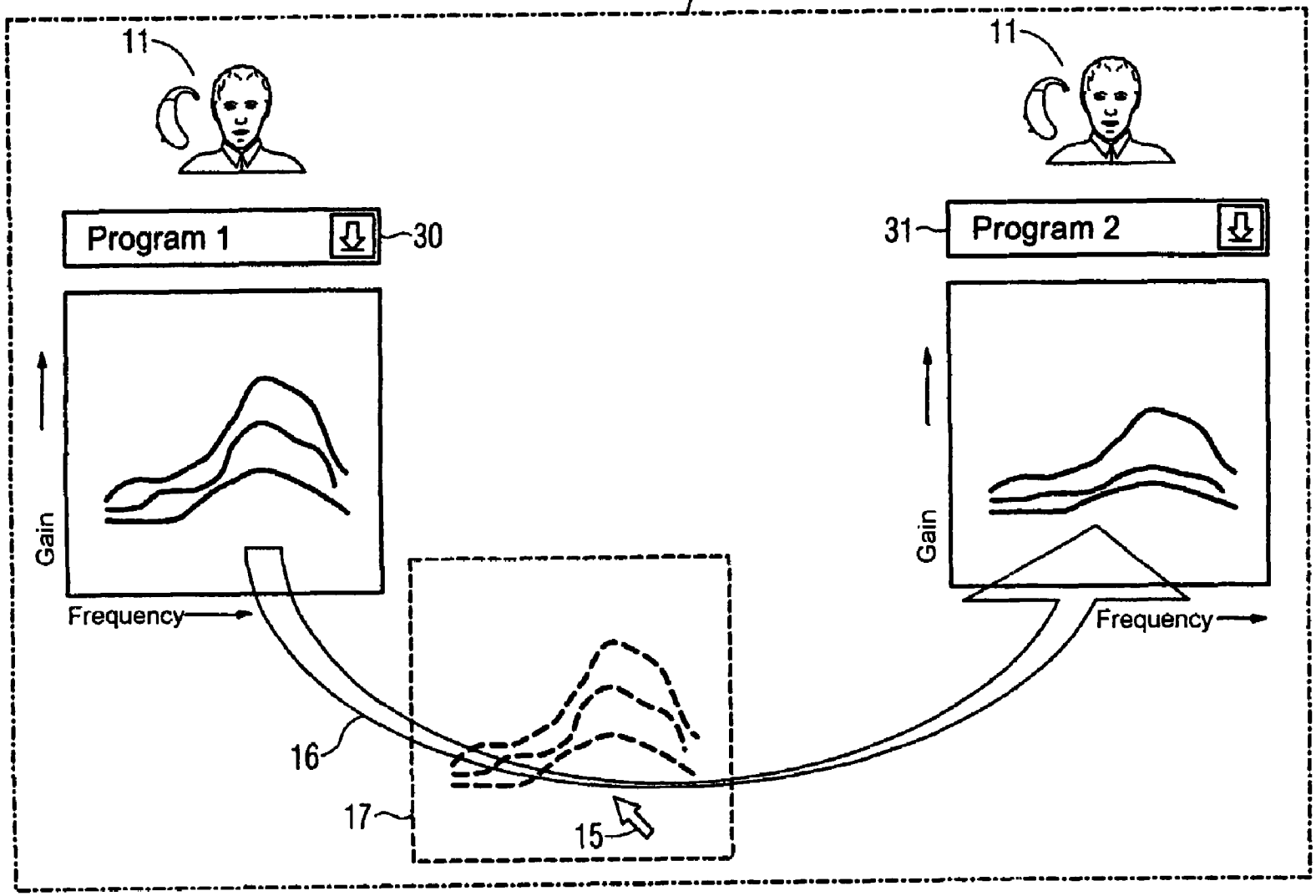
FIG. 6 shows the transmission of characteristic transmission curves of a first hearing program to a second hearing program for one and the same hearing aid.

In contrast to the previously-described exemplary embodiments the screen masks that is shown in FIG. 6 is used only for setting an individual hearing aid (the right-side one in the exemplary embodiment). This is indicated by the identical graphics symbol 11 on the left and the right side of the upper edge of the screen. The screen mask in this case, however, shows simultaneous settings for different hearing programs, namely for program 1 and program 2. These hearing programs are set using the pull-own menus 31 and 32. Using the same operating steps as are used for copying the settings between two different hearing aids, settings in this exemplary embodiment, which relate to different hearing programs of only one hearing aid, are selected from one hearing program (hearing program 1) copied and transmitted to the second hearing program (program 2).

In addition to the purely graphics copying processes described as examples in the exemplary embodiments, the same copying processes can be executed using a clipboard known from Microsoft Windows®. In this case relevant objects such as individual numerical values, characteristic transmission curves or other settings are selected for hearing aid adjustment and first copied into the clipboard. Then the target area is selected and the contents of the clipboard are copied into the target area, which overwrites the original settings present in this area with the copied settings. This method of operation also allows selected settings of one hearing aid to be copied quickly and efficiently to another hearing aid or to another hearing program of the same hearing aid. An advantage of this method is that it enables the user to switch easily between different screen masks which transfers a copy of settings of one screen mask to another screen mask. This method of operation is especially advantageous if it is to be used to copy not only one individual numerical value but a plurality of settings at the same time or when a graphics object such as a characteristic transmission curve or a diagram are copied, saving the user many operating steps in the individual input of these settings which would otherwise be required.

Since the method of operation using clipboard is very similar to the method referred to as "drag-and-drop," reference is also made in this case to the exemplary embodiments previously described. Even when the clipboard is used the computer mouse is used initially to mark a specific area of a graphics user interface which is to be copied. Furthermore a "target area" into which the previously copied settings, characteristic transmission curves etc are to be transmitted is also preferably specified by means of the computer mouse. The difference between the two methods. is only that the copying process using "drag and drop" can be followed directly on the graphical user interface. whereas the copied screen area when the clipboard is used is initially invisible to the user, disappearing into this very clipboard so as to be retrieved again from there when necessary.

Although modifications and changes may be suggested by those skilled in the art, it is the intention of the inventor to embody within the patent warranted hereon all changes and modifications as reasonably and properly come within the scope of his contribution to the art.

We claim:

1. A method for adjusting a transmission characteristic of a hearing aid, using a data processor having a display screen and a manually operable pointer device allowing user interaction with objects displayed by the processor on the display screen, and having a data port configured to communicate with a hearing connected to the data port, said method comprising the steps of:

in a first area of said display screen in a graphics user interface, displaying an object that represents a first hearing program comprising a plurality of first hearing program parameters that respectively define settings that cause a hearing aid to operate according to the first hearing program;

in a second area of said display screen in said graphics user interface, displaying an object representing a second hearing program comprising second hearing program parameters that cause a hearing aid to operate according to said second hearing program;

manipulating said pointer device in said first area on said display screen to select any or all of the first hearing program parameters, as selected parameters;

with said pointer device, moving said object representing the first hearing program, with the selected parameters, from said first area of said display screen to said second area of said display screen;

with said pointer device, causing storage of the selected parameters of said first hearing program to be stored as corresponding parameters of said second hearing program; and connecting a hearing aid to said data port and, via said data port, loading said second hearing program, with said selected parameters of said first hearing program, into said hearing aid, to produce a hearing aid set to operate with said second hearing program and said selected parameters.

2. A method as claimed in claim 1 comprising displaying said first hearing program parameters in said object at said display screen represented by a numerical value or a graphical symbol.

3. A method as claimed in claim 1 comprising displaying said first hearing program parameters in said object at said display screen as a characteristic transmission curve or a section of a characteristic transmission curve.

4. A method as claimed in claim 1 comprising displaying said first hearing program parameters in said object on said display screen as a setting element or a selection element operable by said pointer device.

5. A method as claimed in claim 1 comprising displaying said object in said first area on said display screen in a library containing a plurality of objects, including said object represent said first hearing program.

6. A method as claimed in claim 1 comprising displaying said object in said first area as a file folder including said object represent said first hearing program.

7. A method as claimed in claim 1 comprising maintaining said object visible as said object is moved on said display screen by said pointer device.

8. A method as claimed in claim 1 comprising graphically changing on said display screen at least one of said object represent said first hearing program and said location while said object represent said first hearing program is being moved with said pointer device, to indicate whether said object represent said first hearing program is currently located over a permissible target area within said second area.

9. A method as claimed in claim 1 wherein said first area on said display screen contains a plurality of objects, including said object represent said first hearing program, and comprising graphically changing said object represent said first hearing program on said display screen while moving said object represent said first hearing program with said pointer device to distinguish said object being moved with said pointer device from other objects in said plurality of objects.

10. A method for adjusting a transmission characteristic of a hearing aid, using a data processor having a display screen and a manually operable pointer device allowing user interaction with objects displayed by the processor on the display screen, and having a data port configured to communicate with a hearing connected to the data port, said method comprising the steps of:

in a first area of said display screen in a graphics user interface, displaying an object that represents a first hearing program for a first hearing aid comprising a plurality of first hearing program parameters that respectively define settings that cause a hearing aid to operate according to the first hearing program;

in a second area of said display screen in said graphics user interface, displaying an object representing a second hearing program for a second hearing aid comprising second hearing program parameters that cause a hearing aid to operate according to said second hearing program;

manipulating said pointer device in said first area on said display screen to select any or all of the first hearing program parameters, as selected parameters;

with said pointer device, moving said object representing the first hearing program, with the selected parameters, from said first area of said display screen to said second area of said display screen;

with said pointer device, causing storage of the selected parameters of said first hearing program to be stored as corresponding parameters of said second hearing program; and connecting said second hearing aid to said data port and, via said data port, loading said second hearing program, with said selected parameters of said first hearing program, into said second hearing aid, to produce the second hearing aid set to operate with said second hearing program and said selected parameters of said first hearing program.

11. A method as claimed in claim 10 comprising displaying said first hearing program parameters in said object at said display screen represented by a numerical value or a graphical symbol.

12. A method as claimed in claim 10 comprising displaying said first hearing program parameters in said object at said display screen as a characteristic transmission curve or a section of a characteristic transmission curve.

13. A method as claimed in claim 10 comprising displaying said first hearing program parameters in said object on said display screen as a setting element or a selection element operable by said pointer device.

14. A method as claimed in claim 10 comprising displaying said object in said first area on said display screen in a library containing a plurality of objects, including said object represent said first hearing program.

15. A method as claimed in claim 10 comprising displaying said object in said first area as a file folder including said object represent said first hearing program.

16. A method as claimed in claim 10 comprising maintaining said object visible as said object is moved on said display screen by said pointer device.

17. A method as claimed in claim 10 comprising graphically changing on said display screen at least one of said object represent said first hearing program and said location while said object represent said first hearing program is being moved with said pointer device, to indicate whether said object represent said first hearing program is currently located over a permissible target area within said second area.

18. A method as claimed in claim 17 wherein said first area on said display screen contains a plurality of objects, including said object represent said first hearing program, and comprising graphically changing said object represent said first hearing program on said display screen while moving said object represent said first hearing program with said pointer device to distinguish said object being moved with said pointer device from other objects in said plurality of objects.

* * * * *